United States Patent [19]

Ginzburg

[11] 4,430,876

[45] Feb. 14, 1984

[54] CONTINUOUS TANDEM HOT STRIP MILL AND METHOD OF ROLLING

[75] Inventor: Vladimir B. Ginzburg, Pittsburgh, Pa.

[73] Assignee: Tippins Machinery Company, Inc., Pittsburgh, Pa.

[21] Appl. No.: 306,894

[22] Filed: Sep. 29, 1981

[51] Int. Cl.[3] ..... B21B 1/00; B21B 1/04

[52] U.S. Cl. ..... 72/234; 72/366

[58] Field of Search ..... 72/16, 199, 202, 226, 72/234, 366

[56] References Cited

U.S. PATENT DOCUMENTS 2,002,266 5/1935 Kral ..... 72/202

4,030,326 6/1977 Morooka et al. ..... 72/16

*Primary Examiner*—Francis S. Husar

*Assistant Examiner*—Steven B. Katz

*Attorney, Agent, or Firm*—Webb, Burden, Robinson & Webb

[57] ABSTRACT

The hot strip mill for rolling slabs of a minimum thickness on the order of 7.75 inches into strip on the order of 1000 PIW comprises a plurality of mill stands TM1 through TMx, each of the stands spaced from an adjacent stand by a distance less than the length of the strip between the stands so as to roll in tandem at a constant mass flow. The method of rolling includes reducing slabs into the strip thickness through continuous passes on the TM1 through TMx mill stands while maintaining a constant mass flow on each stand and a minimum temperature differential from head to tail. The method includes selecting the correct slab thickness to achieve the desired productivity and temperature differential.

11 Claims, 5 Drawing Figures

CONTINUOUS TANDEM HOT STRIP MILL AND METHOD OF ROLLING

FIELD OF THE INVENTION

My invention relates to hot strip mills and, more particularly, to continuous hot strip mills for reducing slabs to strip thicknesses, the slabs being of such size as to provide coils on the order of 500 to 1000 PIW and greater

DESCRIPTION OF THE PRIOR ART

Conventional hot strip mills have consisted of a roughing train and a finishing train separated by a holding table to accommodate the transfer bar out of the roughing train and direct that transfer bar into the finishing train at the desired suck-in speed. It has been recognized that the transfer bar loses heat through radiation on the holding table and its heat loss increases as the thickness of the transfer bar decreases. It is also known that there is a temperature differential from front to tail of the product being rolled which temperature differential can affect metallurgical properties of the product and loading requirements of the mill stands. While the slab may be uniformly heated in a reheat furnace, this temperature differential exists because there is a time lapse between when the front end of the slab first enters the hot strip mill and when the tail end of the slab enters the mill.

A number of solutions have been employed to minimize heat loss through radiation and decrease this front-to-tail temperature differential. For example, coil boxes have been provided to hold the transfer bar in coil form prior to introduction to the finishing train. Tunnel furnaces have also been employed over the holding table so that the transfer bar is maintained at the appropriate temperature. Another attempt to solve this problem has been through the utilization of an intermediate mill having coiling furnaces on either side of the reversing mill. While all of these solutions have been successful in varying degrees, there still remains a need for a mill which can handle slabs of such size as to provide the greater PIW coils required in today's market without excessive auxiliary equipment yet still maintain acceptable temperature differentials so as to provide uniform metallurgical properties and not unduly load the individual mill stands.

Previous attempts to provide a true continuous hot strip mill with all stands arranged in tandem for straight-through rolling have been unsuccessful. It is thought that such attempts did not work for there was no recognition of the radiation losses for the slab thicknesses employed. These early attempts involved utilizing slabs on the order of two inches thick and rolling them through a series of stands in a way that is comparable to passing a transfer bar through a finishing mill today. In addition, it has been believed that it is necessary to maximize rolling speeds in the roughing mill and then hold the slab prior to entering the finishing train at an appropriate suck-in speed for continuous finishing on the tandem finishing stands.

SUMMARY OF THE INVENTION

My invention completely eliminates the transfer bar as it is presently known and further eliminates the holding table as it is presently known. Further, my invention greatly reduces the temperature differences between the front and tail of the slab and resultant strip product by continually reducing the slab at a constant mass flow for each mill stand. Further, my invention avoids excessive temperature loss through radiation by eliminating the discontinuity in processing resulting from the existing holding table.

All of this is accomplished while greatly reducing the length of the mill and minimizing the auxiliary equipment utilized heretofore. Finally my invention permits slabs to enter the continuous hot strip mill at temperatures as much as 400° F. less than the temperatures presently employed in existing mills. This translates into a tremendous energy savings and costs associated therewith.

My invention is a continuous tandem hot strip mill for rolling slabs of a minimum thickness on the order of 7.75 inches into strip thicknesses, the coils of which are on the order of 500 to 1000 PIW and greater which comprises a plurality of mill stands TM1 to TMx with each of the stands being spaced from an adjacent stand by a distance less than the length of the strip between the stands so as to roll in tandem therewith at a constant mass flow.

I have found that for a desired temperature front-to-tail differential and a given set of production requirements, i.e., cycle time, it is possible to determine a minimum critical material thickness (h) for entering TM1. The thickness is obtainable from the relationship $\alpha_T = f(h, T)$ and preferably from the empirical relationship $$\Delta T = \left( T_F - 1800 + \frac{1}{n} \right) \cdot (1 - e^{-\alpha \cdot n \cdot t})$$

where $\alpha T$ is the temperature loss rate at the temperature T, $\Delta T$ represents the acceptable front to tail strip temperature differential; $T_F$ is the front end temperature of the slab entering TM1; $\alpha = 2.9/h^{105}$ is the temperature loss rate at 1800° F. in °F./sec.; $n = 0.0025/(1+0.1h)$ is a parameter defining the variation of $\alpha$ with temperature in °F.$^{-1}$; and t is the time interval between the moment when the slab front end enters TM1 and the moment when the slab tail end enters TM1.

DESCRIPTION OF THE PREFERRED EMBODIMENTS

Figure 1:
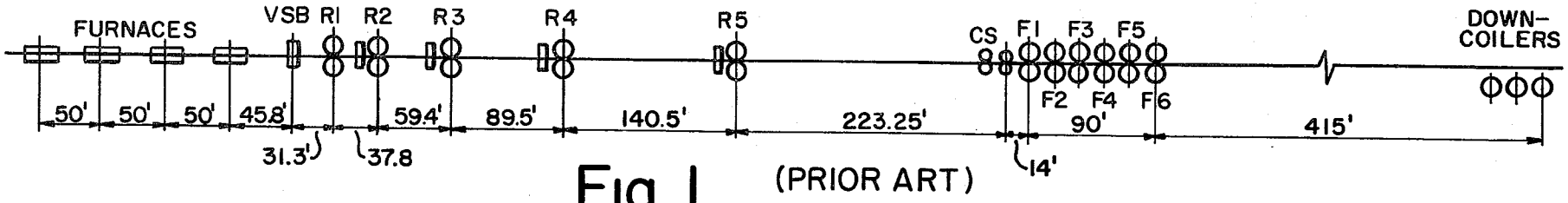
Fig. 1 (PRIOR ART)
FIG. 1 is a schematic showing the general arrangement of a conventional continuous hot strip mill.

The hot strip mill of FIG. 1 is an existing conventional hot strip mill comprised of a roughing train comprised of mill stands R1–R5 with appropriate vertical edgers and scalebreakers and a finishing train comprised of tandem mill stands F1–F6 with appropriate crop shear and scalebreaker. The hot strip mill receives slabs which have been reheated in one of the four furnaces provided. The roughing train is separated from the finishing train by a holding table in excess of 200 feet. A slab is reduced to a transfer bar in the roughing train and then retained on the holding table prior to being fed into the finishing train defined by the mill stands F1–F6. The transfer bar is rolled continuously and in tandem to strip thicknesses on the finishing train. At the exit end of the last finishing stand F6 there is a long runout table which employs cooling water sprays to cool the strip down from the finishing temperature to the desired temperature prior to being coiled on one of three downcoilers. It can be seen that the total length of the hot strip mill from the first roughing stand R1 to the last finishing stand F6 is in excess of 600 feet.

Figure 2:
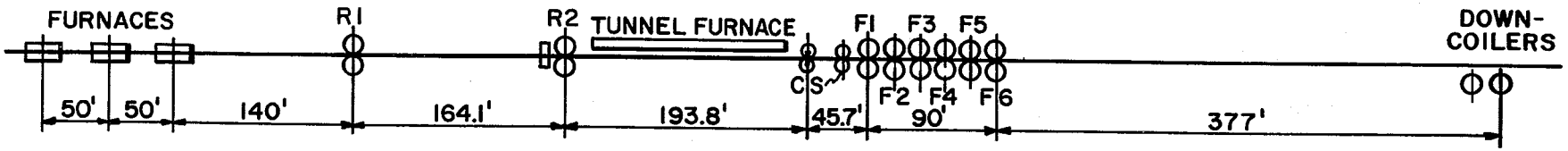
Fig. 2 (PRIOR ART)
FIG. 2 is a schematic showing the general arrangement of an existing modernized hot strip mill employing a tunnel furnace.

One solution to reducing the length of the mill while providing the necessary temperature differential from front to tail of the coil has been through the utilization of a tunnel furnace on the holding table, FIG. 2. This modernized hot strip mill includes three reheat furnaces and two roughing mill stands R1 and R2 which comprise the roughing train. The holding table is on the order of 190 feet and is covered by an appropriate tunnel furnace. The tunnel furnace purportedly equalizes temperature and reduces front-to-tail transfer bar temperature differential. The finishing train preceded by an appropriate crop shear and scalebreaker includes six mill stands F1 through F6 where the strip is rolled continuously and in tandem. A runout table and downcoiler similar to that illustrated in the embodiment of FIG. 1 follows the last finishing stand F6. The length of the hot strip mill of FIG. 2 is less than that of FIG. 1 and is on the order of 490 feet.

Figure 3:
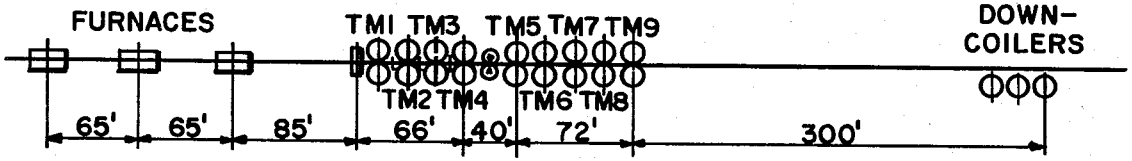
FIG. 3 is a schematic showing the general arrangement of my invention.

My hot strip mill is illustrated in FIG. 3. Three furnaces are illustrated for reheating the slabs to the appropriate temperature. As will be seen hereinafter, the temperature of the slab entering my hot strip mill is on the order of 1800° to 1850° F. which is 400° to 500° F. less than in existing mills. Such a reduced initial temperature makes my hot strip mill adaptable for receiving slabs from a continuous slab caster as well as from reheat furnaces. The mill itself is comprised of nine stands identified as TM1 through TM9. Appropriate vertical edgers are provided before the initial stands TM1 through TM4 and a crop shear is provided between TM4 and TM5. The length of the mill from the first vertical edger through the last stand TM9, is only on the order of 200 feet which is severalfold less than for existing mills as well as modernized mills.

The key to my mill is that the mill stands TM1–TM9 are spaced so that the entire rolling is continuous and in tandem while a constant mass flow is maintained through each rolling mill stand. This constant mass flow is expressed as $h_i \times V_i$=constant, where $h_i$ is the exact thickness out of the stand and $V_i$ is the actual mill stand speed.

Because the front end and the tail end of the slab enter the tandem mill stands at different moments of time, there is an initial temperature differential between the two ends even though the slab is evenly heated. Tjis temperature differential is due to the different time during which the front and tail ends are subjected to heat radiation and convection.

This temperature loss rate ($\alpha_T$) is basically a function of the material thickness (h) and temperature (T), i.e.

$$\alpha_T = f(h, T) \tag{1}$$

Figure 4:
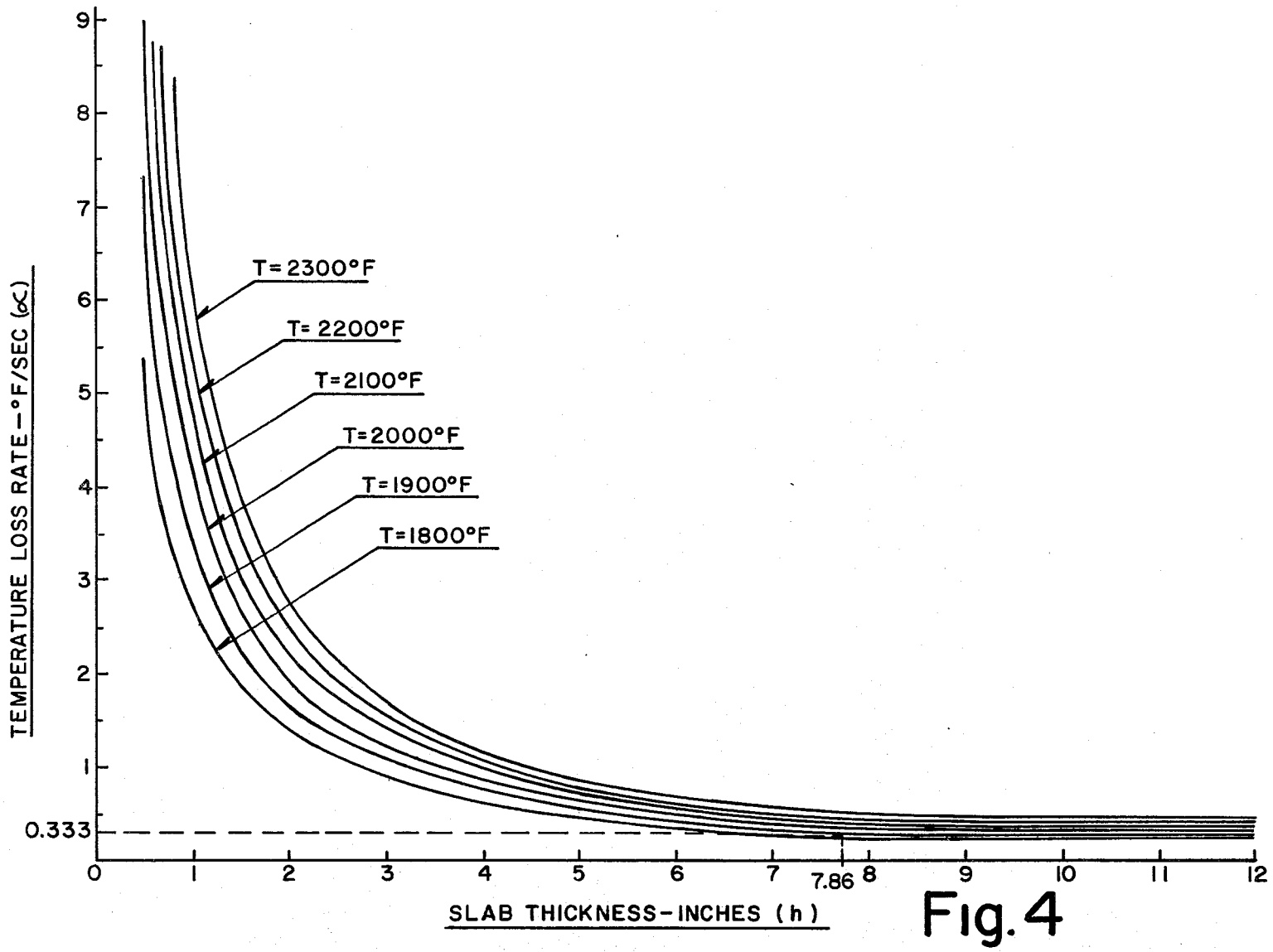
FIG. 4 is a graph showing temperature loss rate due to radiation as a function of material thickness and temperature.

A typical plot of the Equation (1) is shown in FIG. 4. Therefore the temperature differential between the front and tail ends ($\Delta T$) may be calculated as follows $$\Delta T = \alpha_T t \tag{2}$$

where t is the cycle time, or the time interval between the moment when the front end enters the tandem mill and the moment when the tail end enters the tandem mill.

The cycle time is equal to $$t = \frac{1.8 \times (PIW) \times (W)}{(TPH)} \tag{3}$$

where

PIW = the rolling material weight per inch of width (lb./in.),

TPH = the mill production, short tons/hr.

W = the rolling material width, in.

The rolling characteristics of the material and also its metallurgical properties will be uniform when $\Delta T$ is minimum. Practices from the best operated hot strip mills show that $\Delta T$ is satisfactory when:

$$\Delta T \leqq 30° \text{ F.} \tag{4}$$

Now knowing the cycle time (t) and the material temperature ($T_F$) when entering the tandem mill, the critical material thickness $h_{CR}$ to satisfy the Equation (4) can be defined.

For 1000 PIW and W = 40 in. and 800 TPH, I determine from Equation (3)

$$t = \frac{(1.8) \times (1000) \times (40)}{(800)} = 90 \text{ sec.}$$

Then from Equation (2) and Equation (4) I determine $$\alpha = \frac{\Delta T}{t} = \frac{30}{90} = 0.333° \text{ F./sec.}$$

Referring to FIG. 4, I determine that $$h_{CR} = 7.86 \text{ in.}$$

It should be noted that Equations (1) and (2) are valid when the material temperature is constant.

In fact, the temperature is decreasing with time. This temperature decay is taken into account in the following equation.

$$\Delta T = \left(T_F - 1800 + \frac{1}{n}\right)(1 - e^{-\alpha \cdot n \cdot t}) \tag{5}$$

where $T_F$ = front end temperature when entering the mill, °F.; e is the logarithmic base; $\alpha$ = temperature loss rate at 1800° F., °F./sec.; and n = parameter defining the variation of $\alpha$ with temperature, °F.$^{-1}$. $\alpha$ in turn is $$\alpha = 2.9/_h 105 \tag{6}$$

and $$n = \frac{0.0025}{1 + 0.1\,h} \tag{7}$$

Figure 5:
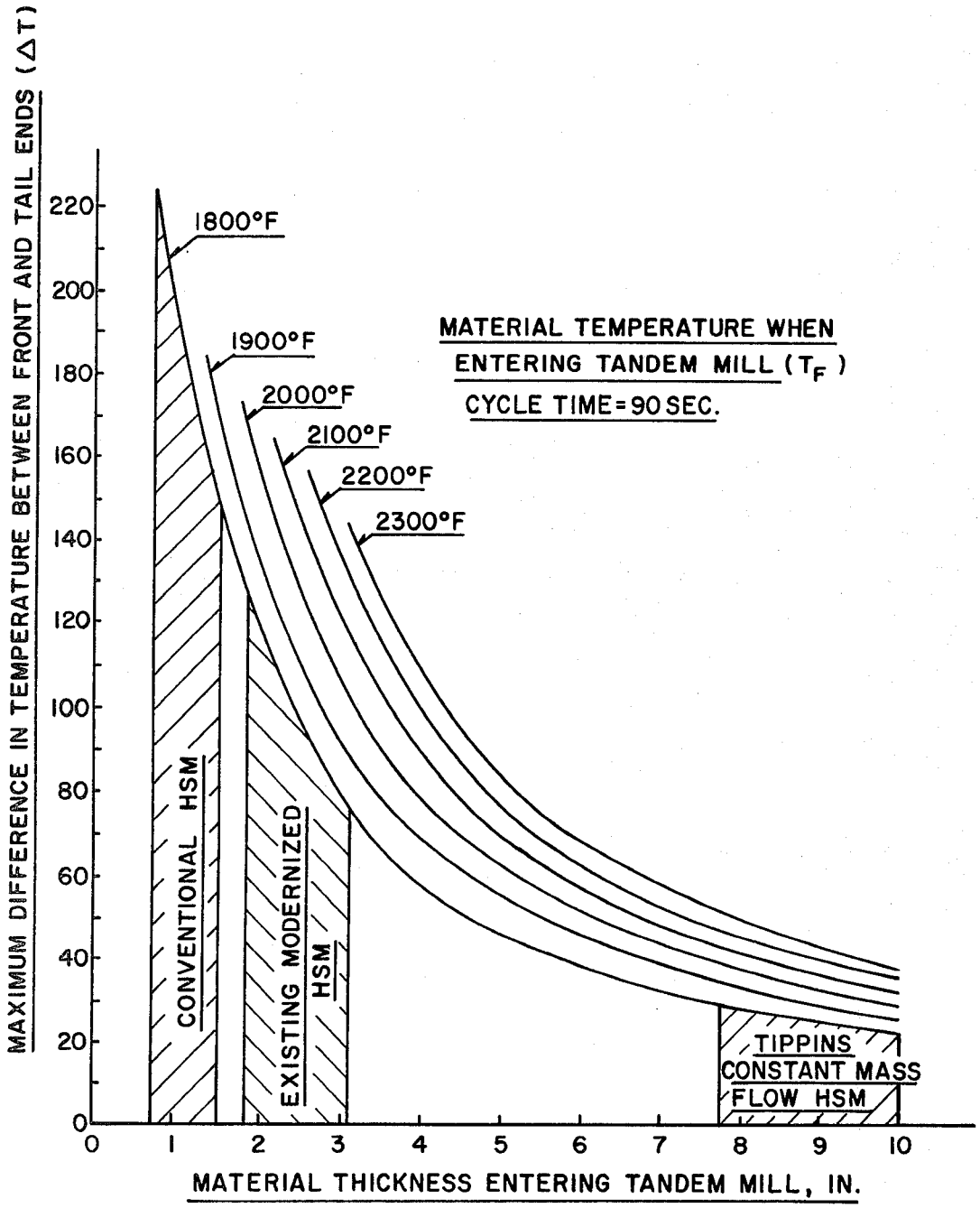
FIG. 5 is a graph showing the effect of material thickness entering the tandem mill in relation to the difference in temperature between front and tail ends of the slab.

The Equations (5) through (7) are plotted in FIG. 5 for the cycle time of the earlier example.

From FIG. 5 we can compare performance characteristics of the conventional HSM, the existing modernized HSM and my invention.

The material thickness h entering the tandem finishing train in the conventional hot strip mill (FIG. 1) is within the following range:

$$0.75 \leqq h \leqq 1.5 \text{ in.} \quad (8)$$

For some hot strip mills (FIG. 2) built or modernized in the late 70's, the range was shifted to:

$$1.8 \leqq h \leqq 3.15 \text{ in.} \quad (9)$$

Finally, the material temperature when entering the tandem finishing train for existing mills is normally above 1800° F. with the slabs exiting the furnace for introduction into the roughing mill at 2250° F.

As it follows from FIG. 5, the condition (5) is not satisfied for the range (8) or for the range (9). To compensate for an excessive temperature drop, a number of different solutions have been suggested including the coil box, an additional stand preceding the tandem mill and the tunnel furnace installed between roughing and finishing trains, also acceleration of the mill, etc. This results in further complication of the installation, operation and maintenance of the hot strip mill.

However, it can be seen from FIG. 5 that the material thickness h must exceed a certain critical value $h_{CR}$ as expressed below.

$$h > h_{CR} \quad (10)$$

In other words, when $h > h_{CR}$, the condition (4) will be satisfied without any additional measures mentioned above. The magnitude of $h_{CR}$ depends on the slab length (or the slab weight per inch of width), the slab temperature and the rolling cycle time. For a slab with 1000 PIW and cycle time equal to 90 seconds we obtain $h_{CR} = 7.75$ in.

Thus, if a 7.75 inch thick slab at 1800° F. is entered into my tandem mill, the front-to-tail temperature differential of the finished product will be no more than 30° F. In reality, the higher temperature dissipates faster than the lower temperature and, therefore, the temperature differential continues to diminish as the strip travels through my mill.

From the relationship between the transfer bar thickness and front and tail end temperature differential illustrated in FIG. 5, it can be seen that for the conventional hot strip mill of FIG. 1 and for the existing modernized hot strip mill of FIG. 2, the transfer bar thicknesses entering the finishing train are located at the end of the curves which result in high front-to-tail temperature differentials and which thus require higher initial slab temperatures as well as auxiliary equipment such as zooming, tunnel furnaces and the like. On the other hand, it can be seen that the Tippins constant mass flow hot strip mill will provide a front-to-tail temperature differential on the order of 30° F. for slabs entering the mill at 1800° F. at a thickness of 7.75 inches and greater without the need for any such auxiliary equipment.

Therefore, as long as one knows the requirements for PIW, ΔT and the width of the product which is normally based on a weighted average of the product mix and the TPH production requirements, the given minimum critical slab thickness can be readily determined from the Equations (5) through (7), or the respective curves such as FIG. 5.

The following Table 1 is a rolling schedule and temperature profile for the rolling of a slab into strip thicknesses on my continuous tandem hot strip mill. The slab of low carbon steel has a thickness of nine inches, a width of 39.5 inches and a length of 32.72 feet. The temperature out of the furnace is 1850° F. and the final strip thickness is 0.111 inch.

TABLE 1

Rolling Schedule and Temperatures

| Mill | Gauge ($h_i$) in. | Mill Speed ($V_i$) FPM | Mass Flow ($h_i V_i$) in. × FPM | Temperature Entry Front | Temperature Entry Tail | Temperature Exit Front | Temperature Exit Tail | Rated H.P. | Reduction % |
|---|---|---|---|---|---|---|---|---|---|
| Furnace | 9.000 | — | — | 1850 | 1850 | 1850 | 1850 | — | — |
| VE | 9.000 | 21.6 | 194.3 | 1844 | 1817 | 1810 | 1782 | 1500 | — |
| TM1 | 7.000 | 27.8 | 194.3 | 1798 | 1771 | 1794 | 1768 | 1500 | 22.2 |
| TM2 | 5.000 | 38.8 | 194.3 | 1770 | 1744 | 1734 | 1709 | 2500 | 28.6 |
| TM3 | 3.000 | 64.8 | 194.3 | 1711 | 1687 | 1715 | 1691 | 5000 | 40.0 |
| TM4 | 1.250 | 155.4 | 194.3 | 1692 | 1669 | 1705 | 1683 | 10000 | 58.3 |
| TM5 | 0.600 | 323.8 | 194.3 | 1682 | 1660 | 1661 | 1640 | 6000 | 52.0 |
| TM6 | 0.3300 | 588.6 | 194.3 | 1648 | 1627 | 1659 | 1639 | 6000 | 45.0 |
| TM7 | 0.205 | 946.6 | 194.3 | 1645 | 1626 | 1654 | 1636 | 6000 | 37.9 |
| TM8 | 0.138 | 1407.6 | 194.3 | 1640 | 1623 | 1647 | 1630 | 6000 | 32.7 |
| TM9 | 0.111 | 1750.0 | 194.3 | 1634 | 1617 | 1634 | 1619 | 4000 | 19.6 |

It can be seen that providing constant mass flow and exiting TM9 at temperatures on the order of 1617°–1634° F. requires an entrance speed into the initial stand TM1 of only 27.8 ft./min. and subsequent speeds through TM3 of only 64.8 FPM. Heretofore it has been the practice to enter the roughing train at much higher speeds. Yet the subject mill has a peak productivity of 781.7 TPH or 4 million tons per year which compares favorably with existing mills.

The temperature differential of the final product out of TM9 is on the order of 17° F. and the initial slab temperature was only 1850° F. This has been achieved without the benefit of any zoom or auxiliary equipment or supplemental heating.

It can, therefore, be seen that I have a provided a mill where there is no discontinuity in process resulting in additional temperature loss. In addition, the entire mill is operating at a constant mass flow and an optimum speed for a given slab thickness. Therefore, the operation is simplified and because of the tremendous decrease in slab temperature out of the furnace, tremendous conservation of energy has also been achieved. I have found for every cycle time there is a critical material thickness entering the continuous tandem mill which provides the acceptable temperature differential from front to tail to achieve uniform metallurgical properties and acceptable rolling conditions.

I claim:

1. The method of hot rolling a heated slab continuously from slab thickness to strip thickness in a mill having a plurality of mill stands TM1–TMx arranged in tandem and spaced from each other a distance less than the length of strip between stands comprising reducing the material in each stand an amount commensurate with the maintenance of a constant mass flow in each of the stands, the entering slab thickness and temperature and the rolling speed being such as to provide a temperature differential between the front end and the tail end exiting from the last finishing stand of less than approximately 30° F., and determining the slab thickness h entering the initial stand from the empirical relationship:

$$\Delta T = \left( T_F - 1800 + \frac{1}{n} \right) (1 - e^{-\alpha \cdot n \cdot t})$$

where ΔT represents the acceptable front-tail strip temperature differential, $T_F$ is the front end temperature of the slab entering TM1, α is the temperature loss rate at 1800° F. in °F./sec., n is a parameter defining the variation of α with temperature, °F.$^{-1}$ and t is the time interval between the moment when the slab front enters TM1 and the moment when the slab tail enters TM1, wherein n and α are functions of h.

2. The method of claim 1 wherein the mass flow as a product of exit thickness by mill speed is on the order of 200 in. × FPM.

3. The method of hot rolling to strip thickness on a hot strip mill having a plurality of mill stands TM1–TMx arranged in tandem and spaced from each other a distance less than the length of strip between stands comprising selecting a minimum thickness (h) for a material having a front and tail end entering the mill stands based on the cycle time for the mill and a desired temperature front-tail differential for said material and reducing said material to said strip through a continuous pass through said mill stands while maintaining a constant mass flow from stand to stand, said thickness (h) based on the relationship $\alpha_T = f(h, T)$ were $\alpha_T = \Delta T/t$, ΔT being the desired temperature differential, t being the cycle time and T being the temperature, said thickness obtained from the plot of FIG. 4.

4. The method of hot rolling to strip thickness on a hot strip mill having a plurality of mill stands TM1–TMx arranged in tandem and spaced from each other a distance less than the length of strip between stands comprising selecting a minimum thickness (h) for a material having a front and tail end entering the mill stands based on the cycle time for the mill and a desired temperature front-tail differential for said material and reducing said material to said strip through a continuous pass through said mill stands while maintaining a constant mass flow from stand to stand, said thickness (h) based on the relationship $$\Delta T = \left( T_F - 1800 + \frac{1}{n} \right) (1 - e^{-\alpha \cdot n \cdot t})$$

where ΔT represents the acceptable front-tail strip temperature differential, $T_F$ is the front end temperature of the slab entering TM1, α is the temperature loss rate at 1800° F. in °F./sec., n is a parameter defining the variation of α with temperature, °F.$^{-1}$ and t is the time interval between a moment when the slab front enters TM1 and the moment when the slab tail enters TM1, said thickness obtained from the plot of FIG. 5.

5. The method of hot rolling a heated slab continuously from slab thickness to strip thickness which comprises passing the slab continously through and reducing it in a series of mill stands arranged in tandem, the entering slab thickness being on the order of 7.75 inches or greater and the entering temperature being on the order of 1800° to 1850° F., reducing the slab in each stand an amount commensurate with the maintenance of a constant mass flow in each of the stands, the temperature differential between the front end and the tail end exiting the last stand being on the order of 30° F. or less.

6. The method of claim 5 in which the last stand is operated at a rolling speed on the order of 1750 ft./min. and the reduction taken in said stand is on the order of 20%.

7. The method of rolling slabs into strip which, when coiled, is on the order of 1000 PIW, on a hot strip mill including mill stands TM1–TMx comprising:

selecting a slab having a minimum slab thickness and a mill entering temperature to meet a desired maximum differential from front to tail of the strip from the curve of FIG. 5;

reducing said slab to strip thickness by passing it continously through TM1 through TMx while maintaining a constant mass flow on each stand.

8. A method of rolling slabs having a minimum slab thickness of 7.75 inches into strip which, in coil form, has a PIW on the order of 1000 on a hot strip mill including nine mill stands, TM1 through TM9, spaced for continuous tandem rolling, including:

introducing the slab into the mill at a temperature on the order of 1800° F.; and successively reducing said slab to a strip thickness by a continuous tandem pass through TM1 through TM9, respectively, while maintaining a constant mass flow in each stand;

whereby said strip is characterized by a finishing temperature out of TM9 which has a 30° F. or less differential between the front end and the tail end.

9. The method of claim 8 including passing strip through TM9 at a rolling speed on the order of 1750 ft./min. with a reduction on the order of 20%.

10. The method of claim 8 including passing the slab through TM1 at a rolling speed on the order of 27 ft./min. with a reduction on the order of 22%.

11. A method of rolling slabs having a thickness on the order of 9 inches thick into strip on the order of 0.111 inch on a strip mill including mill stands TM1 through TM9 spaced for continuous tadem rolling comprising:

(A) introducing a slab having a temperature on the order of 1800° to 1850° F. into TM1, (B) reducing said slab by rolling through said mill stands in accordance with the following rolling schedule:

| | Exit Gauge (in.) | Mill Speed (FPM) |
|---|---|---|
| TM1 | 7 | 27.8 |
| TM2 | 5 | 38.8 |
| TM3 | 3 | 64.8 |

-continued

| | Exit Gauge (in.) | Mill Speed (FPM) |
|---|---|---|
| TM4 | 1.25 | 155.4 |
| TM5 | 0.60 | 323.8 |
| TM6 | 0.33 | 588.6 |

-continued

| | Exit Gauge (in.) | Mill Speed (FPM) |
|---|---|---|
| TM7 | 0.2305 | 947.6 |
| TM8 | 0.138 | 1407.6 |
| TM9 | 0.111 | 1750.0 |

whereby said strip has a temperature differential from front to tail exiting TM9 on the order of 170° F.

* * * * *

UNITED STATES PATENT AND TRADEMARK OFFICE

CERTIFICATE OF CORRECTION

PATENT NO. : 4,430,876

DATED : February 14, 1984

INVENTOR(S) : Vladimir B. Ginzburg

It is certified that error appears in the above-identified patent and that said Letters Patent are hereby corrected as shown below:

Column 2 Line 39 "105" should read --1.05--.

Column 3 Line 61 "Tjis" should read --This--.

Column 4 Line 62 "105" should read --1.05--.

Column 6 Line 58 Delete --a-- (first occurrence).

Claim 3 - Column 7 Line 45 "were" should read --where--.

Claim 11 - Column 10 Line 9 "170°F" should read --17°F--.

Signed and Sealed this

*Twenty-second* Day of *May 1984*

[SEAL]

*Attest:*

GERALD J. MOSSINGHOFF

*Attesting Officer*

*Commissioner of Patents and Trademarks*